United States Patent [19]

Armistead

[11] 4,241,955

[45] Dec. 30, 1980

[54] STORAGE RACK FOR RECORD ALBUMS

[76] Inventor: Hubert P. Armistead, 1204 Wilkes Blvd., Columbia, Mo. 65201

[21] Appl. No.: 32,356

[22] Filed: Apr. 23, 1979

[51] Int. Cl.[3] ..... A47F 1/04

[52] U.S. Cl. ..... 312/12; 312/15; 211/40

[58] Field of Search ..... 312/10, 15, 12, 316, 312/18; 206/387; 211/13, 40

[56] References Cited

U.S. PATENT DOCUMENTS

| | | | |
|---|---|---|---|
| 895,655 | 8/1908 | Mitchell . | |
| 1,599,039 | 9/1926 | Carter | 312/15 |
| 2,422,594 | 6/1947 | Stengren | 312/10 |
| 2,720,204 | 10/1955 | Wallach | 312/12 |
| 2,825,465 | 3/1958 | Burgo | 312/10 |
| 2,944,859 | 7/1960 | Ivanoff | 312/15 |
| 3,052,507 | 9/1962 | Wallach | 312/12 |
| 3,265,453 | 8/1966 | Seide | 312/13 |
| 3,288,543 | 11/1966 | Sugarman | 312/12 |
| 4,022,320 | 5/1977 | Hadley | 206/310 |

*Primary Examiner*—Casmir A. Nunberg
*Attorney, Agent, or Firm*—Fishburn, Gold and Litman

[57] ABSTRACT

A storage rack for record albums and the like has a planar bottom wall adapted for engagement with a top surface of a bottom supportive structure such as a shelf and a planar top wall adapted for engagement with a bottom surface of a top supportive structure such as a shelf whereby the top and bottom walls are spaced apart vertically a distance not less than a height dimension of the record album. A plurality of elongate vanes respectively extend from the top and bottom walls and form parallel guide channels on the top and bottom walls open from front to rear. Relatively narrow trays are movably mounted in the respective guide channels and slide outwardly for carrying an album and presenting the album for retrieval. A plurality of elastic connectors extend between upper and lower, or vertically paired vanes and form flexible partitions dividing the storage rack into a plurality of side-by-side receptacles for inserting the articles therein.

8 Claims, 4 Drawing Figures

STORAGE RACK FOR RECORD ALBUMS

This invention relates to storage cabinets or racks and particularly to such facilities for storing planar articles such as record albums.

Various types of storage devices for retaining records or record albums are known in the art but are generally rather heavy and bulky structures employing a plurality of rigid walls or partitions dividing the storage structure into compartments for individual records or albums. These compartments can become dirty with use and because the compartments are too narrow to permit insertion of a cleaning tool, are difficult to clean. Yet, without having the individual partitions in a storage cabinet, the records or albums can be damaged and become unsuitable for use.

Further, prior art record storage structures are generally self contained and are not readily adaptable for use in existing furniture structures.

In view of the above, the principal objects of the present invention are: to provide an improved storage rack for storing records and albums in an orderly manner; to provide such a storage rack which retains records and albums in a convenient manner for easy selection of a record for use; to provide such a storage rack whereby records are held in a compact relationship and occupy a minimum space for storage; to provide such a storage rack which is adapted for attachment to existing shelf or cabinet structures; to provide such a storage rack having a plurality of elongate, parallel guide channels with trays slidably mounted therein for removing records from the storage rack; to provide such a storage rack having a plurality of elastic connectors forming light weight, stretchable partitions spaced for receipt of record albums; to provide such a storage rack having elastic partitions which are easily pulled aside or parted for insertion of cleaning tools into the storage rack; and to provide such a storage rack which is relatively inexpensive, highly reliable in use and well adapted for its intended purpose.

Other objects and advantages of this invention will become apparent from the following description taken in connection with accompanying drawings wherein are set forth by way of illustration and example, certain embodiments of this invention.

Figure 1:
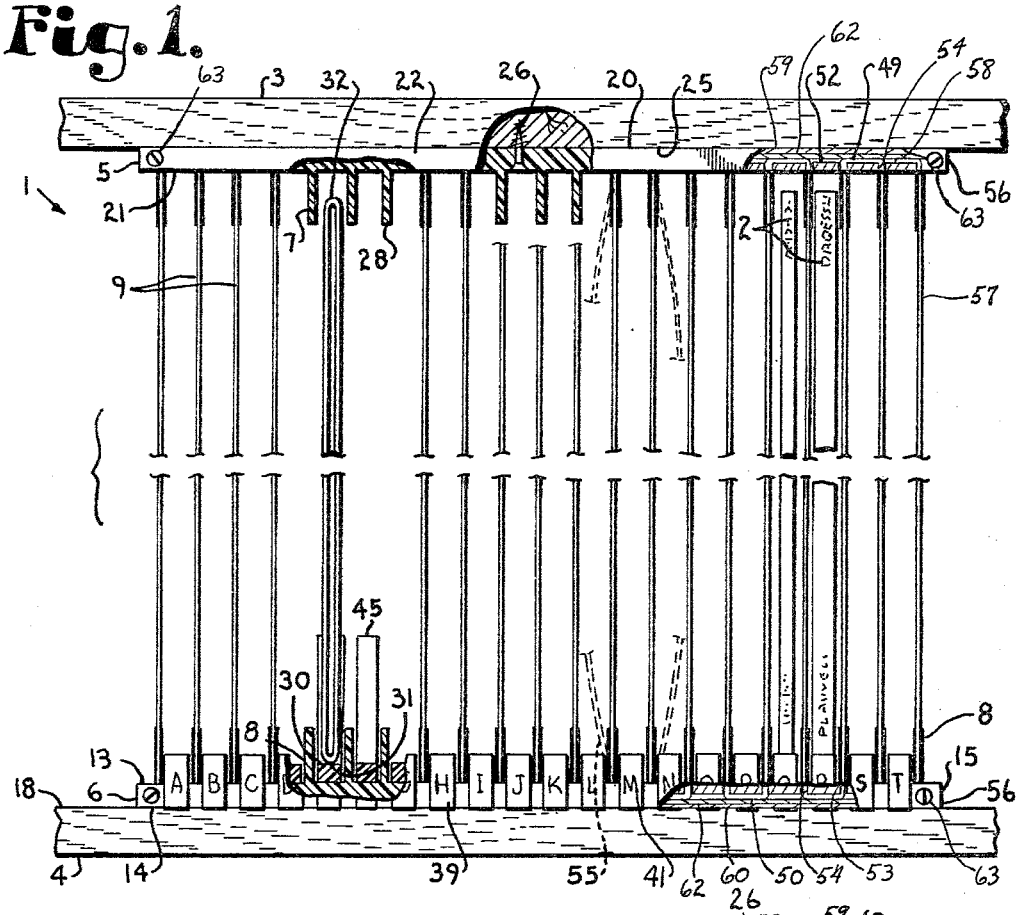
FIG. 1 is a front elevational view of a storage rack embodying the present invention and having portions broken away to show interior details thereof.
Figure 2:
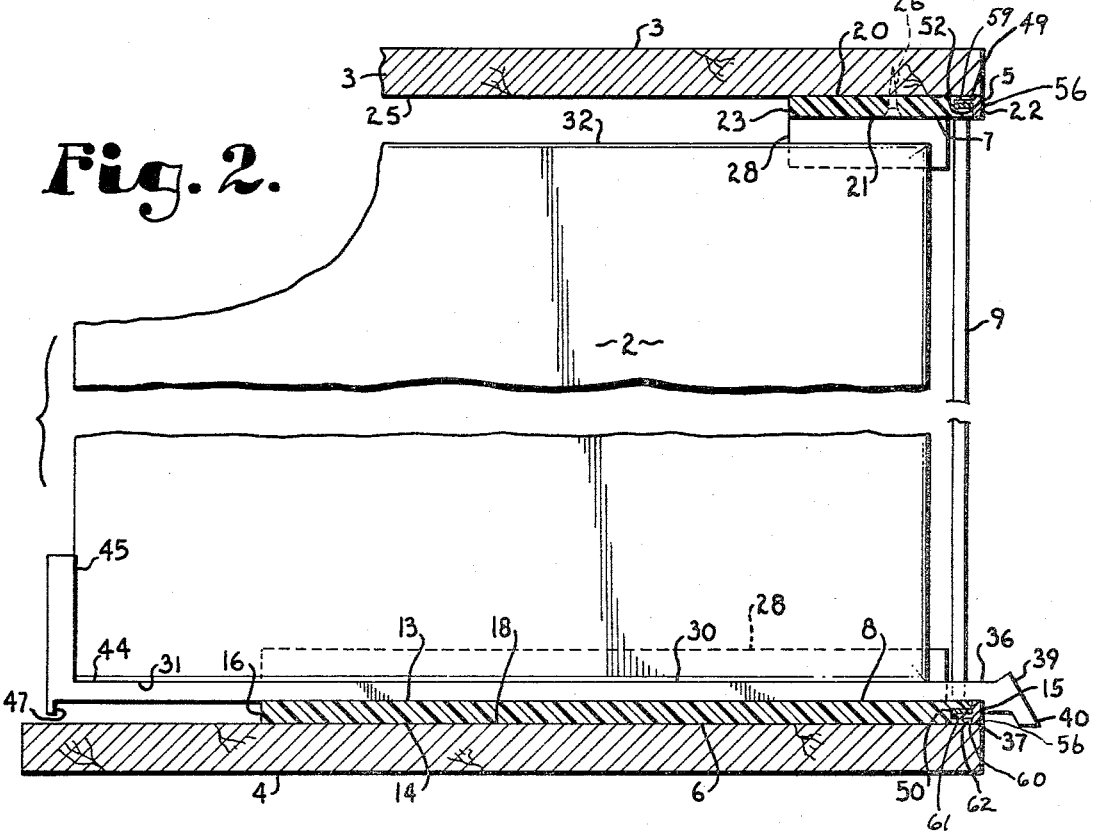
FIG. 2 is a front to rear sectional view taken along lines 2—2, FIG. 1.
Figure 3:
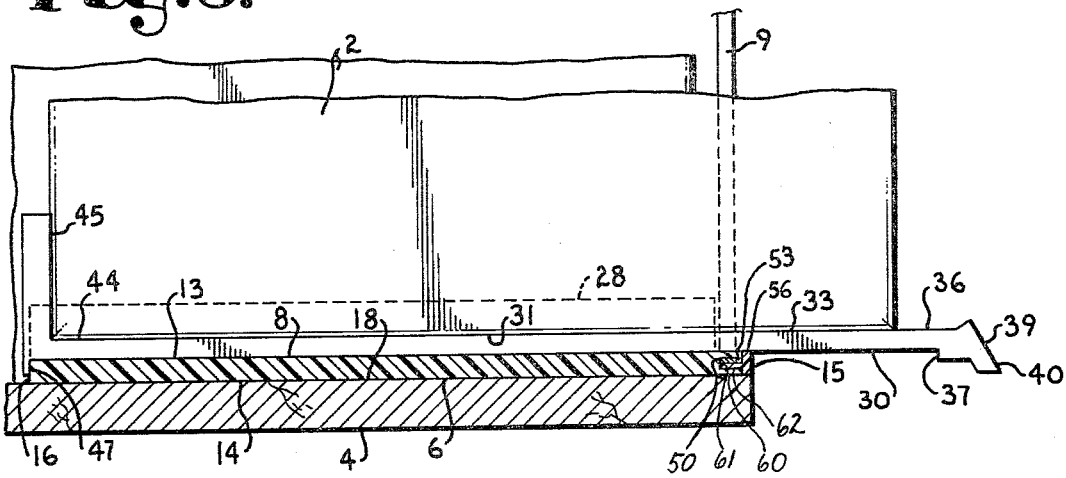
FIG. 3 is an enlarged, fragmentary view of the storage rack showing details thereof.
Figure 4:
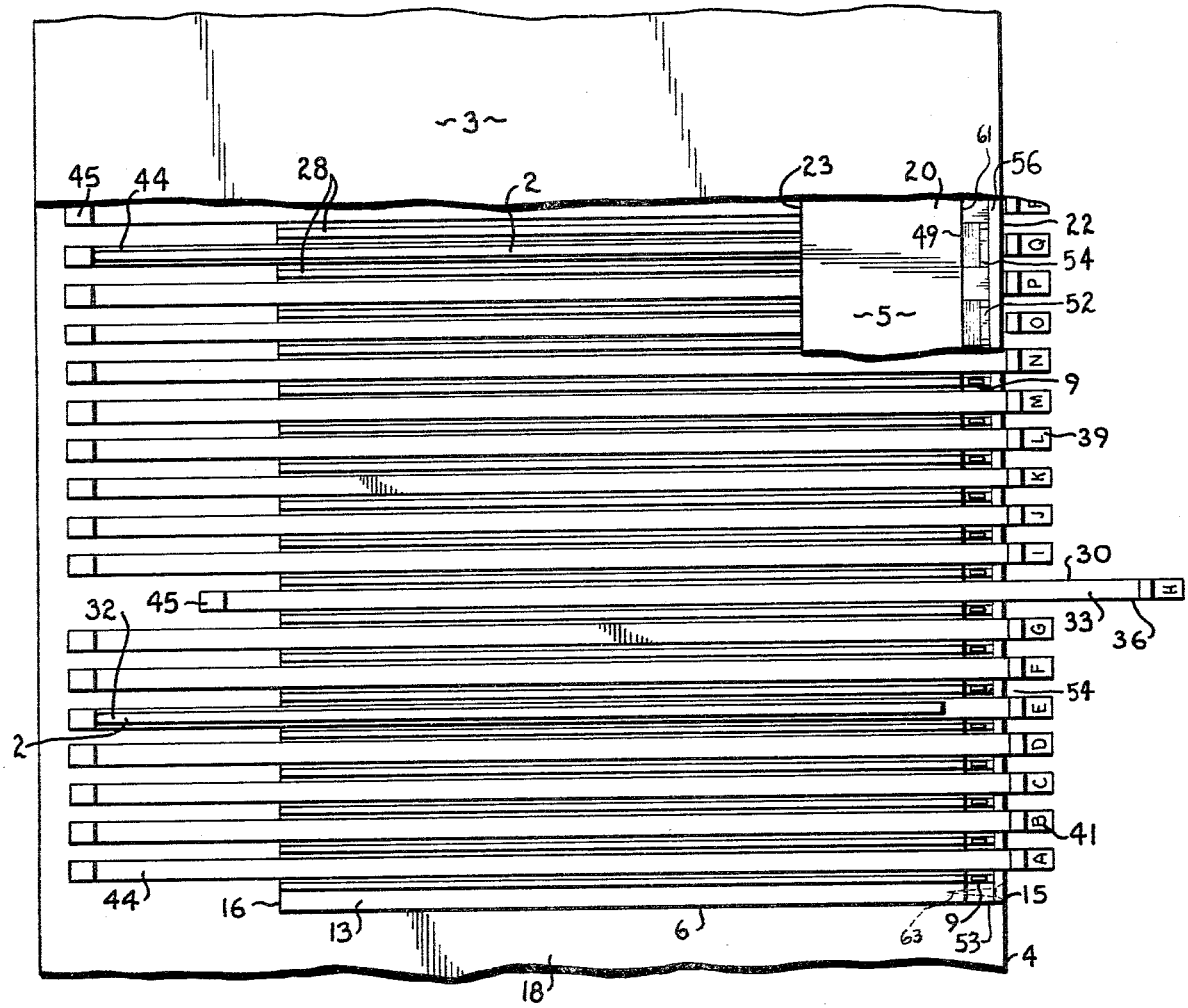
FIG. 4 is a top plan view of the storage rack having portions broken away to show interior details thereof.

Referring more in detail to the drawings:

FIG. 1 depicts a storage rack, generally designated by the reference numeral 1, embodying the present invention and having a plurality of relatively thin articles such as, but not limited to, record albums 2 and the like. In the illustrated example, the storage rack 1 is positioned between upper and lower shelves 3 and 4 of a suitable article of furniture such as a cabinet and has top and bottom walls 5 and 6 with respective guide channels 7 and 8 for receipt of the record albums. A plurality of elastic dividers or connectors 9 extend between the top and bottom walls 5 and 6 and define stretchable partitions dividing the storage rack 1 into side-by-side compartments sized for respectively receiving the record albums 2 and which can be pulled aside to insert one's hand, cleaning tools and the like into the storage rack 1.

It is with the contemplation of this invention that the storage rack 1 can be built into an existing cabinet or grouping of shelves or can be adapted for use as a unitary structure in which the top and bottom walls 5 and 6 could become exterior walls and suitable upright supports, such as sidewalls (not shown) mounted therebetween to space the top wall 5 vertically from the bottom wall 6.

The storage rack 1 and interior parts thereof as described below, are preferably constructed of a readily formed synthetic plastic resin such as polystyrene, polypropylene, or ABS, including such products as Plexiglas, Lexan and the like. Therefore, it is desired that the completed structure be relatively light in weight, resistant to breakage, and free from maintenance.

The storage rack 1 includes coordinating record receiving guides and partitions and in the illustrated example, the bottom wall 6 is horizontally elongate and planar in shape, having upper and lower surfaces 13 and 14 with front and rear margins 15 and 16. The lower surface 14 of the bottom wall 6 lies flatly upon an upper surface 18 of the lower shelf 4 and is secured thereto by suitable adhesives or the like.

Spaced vertically from the bottom wall 6 in superimposed relation therewith is an elongate, planar top wall 5 likewise having upper and lower surfaces 20 and 21 and front and rear margins 22 and 23. The upper surface 20 of the top wall 5 is mounted to a lower surface 25 of the upper shelf 3 by suitable fastening means such as screws 26 or the like.

The bottom wall 6 is preferably of greater distance from the front margin 15 to the rear margin 16 than the distance from the front margin 22 to the rear margin 23 of the top wall 5 for providing a supportive surface underlying the record albums 2. Further, the top wall 5 is preferably spaced above the bottom wall 6 a distance commensurate with or at least not less than the vertical height of the record albums 2 whereby the record albums 2 are oriented in an upright position and slid into the storage rack 1.

A plurality of thin, elongate rib members or vanes 28 are affixed normally or on edge to the respective upper and lower surfaces 13 and 21 of the top and bottom walls 5 and 6 and have a longitudinal axis extending between the respective front and rear margins 15 and 16 and 22 and 23. The vanes 28 further extend into the space between the top and bottom walls 5 and 6, thereby defining walls for the plurality of top and bottom guide channels 7 and 8.

A plurality of narrow slats or trays 30 lift in and out of the storage rack 1 for slidable engagement in the bottom guide channels 8. Each tray 30 respectively has an upper surface 33 for supporting a bottom edge 31 of the record album 2 and a lower surface 34 slidably engaged with the upper surface 13 of the portion of the bottom wall 6 within each guide channel 8. A front portion 36 of each tray 30 has a stop 37 on the lower surface 34 which contacts the front margin 15 of the bottom wall 6 and limits movement of the tray 30 into the storage rack 1. An inclined end piece 39 is mounted to the front portion 36 to face a viewer and has a lower tab 40 providing a finger hold. A plurality of identifying marks, such as letters 41, facilitate a filing system for the record albums 2.

Each tray 30 preferably has a longitudinal length longer than the bottom edge 31 of the record album 2 and includes a rear portion 44 with an upwardly extending arm 45 mounted normally thereon for contacting a record album rear edge 46 and limiting rearward movement of the record album 2 relative to the tray 30. A rear stop 47 extends downwardly from the arm 45 and projects below the tray lower surface 34 for engaging the wall rear margin 16 and limiting outward movement of the tray 30 from the storage rack 1.

The elastic connectors 9 extend between the top and bottom walls 5 and 6 and have opposite upper and lower portions 49 and 50 suitably secured to connecting portions in the walls 7 and 8 adjacent the respective margins 15 and 22. In the illustrated example, the elastic connectors 9 are comprised of a single length of elastic cord 57 woven between a plurality of protruding tongues or lugs 52 and 53 which respectively extend forwardly of the top and bottom guide channels 7 and 8 and have short, vertical slots 54 therebetween in line with each vane 28 whereby a continuous length of elastic cord 57 can be looped over top and bottom alternate tongues or lugs 52 and 53 to form the upper and lower portions 49 and 50 and extend through the slots 54 to complete a series of parallel partitions extending the length of the storage rack 1, FIG. 1. Each end 58 of the cord 57 is secured to an end tongue or lug 52 or 53 by suitable means, such as adhesive, FIG. 1.

In the illustrated example, the front margins 15 and 22 of the respective bottom and top walls 7 and 8 are the front faces of elongate strips 56 respectively extending the length of the bottom and top walls 7 and 8. The top and bottom walls 7 and 8 have elongate flanges 59 and 60 extending the length thereof and spaced from the respective tongues or lugs 52 and 53 a sufficient distance to form elongate grooves 61. The strips 56 have rear arms or flanges 62 for receipt into the respective grooves 61 whereby the strips 56 are detachably connected along forward edges of the respective tongues or lugs 52 and 53 with the arms or flanges 62 pressing against the respective upper and lower portions 49 and 50 of the elastic connectors 9 for removal of excessively worn or broken elastic connectors 9 and replacement thereof as necessary. A plurality of fasteners 63, such as screws, extend through the strips 56 and into the respective top and bottom walls 7 and 8 to prevent inadvertent disengagement of the strip 56.

The elastic connectors 9 provide visual alignment for inserting the record albums in vertical orientation whereby the album top and bottom edges 31 and 32 slide into opposed, vertically aligned, top and bottom guide channels 7 and 8. Further, should access to the interior of the storage rack 1 be required for cleaning, retrieval of misplaced or dropped objects or the like, the elastic connectors 9 can be manually spread or pulled apart, FIG. 1, to a stretched or bowed position 55 whereby a hand, vacuum cleaner wand or other object can be inserted therebetween and into the interior of the storage rack 1.

In use of the storage rack 1, the top and bottom walls 5 and 6 are suitably secured as described above to respective upper and lower surfaces 18 and 25 of the upper and lower shelves 3 and 4. Using the tabs 40 as a fingerhold, selected trays 30 are slidably pulled from the bottom wall 6 and respective guide channels 8 until the rear stop 47 contacts the rear margin 16 of the bottom wall 6. The record album 2 is oriented to an upright position and the bottom edge 31 thereof placed on the upper surface 23 of the tray 30 so that the record album 2 is aligned between a pair of partitioning elastic connectors 9 whereby the album top edge 32 is in line with a top guide channel 7.

The tray 30 and record album 2 is slid into the storage rack 1 until the front stop 37 contacts the wall front margin 15 and arrests sliding movement of the tray 30.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A storage rack for articles such as phonograph albums and the like comprising:

(a) top and bottom walls having front and rear portions;

(b) means supporting said top wall in overlying relation to said bottom wall and spaced therefrom a distance not less than a height dimension of articles for insertion into the storage rack;

(c) a plurality of elongate, parallel vanes extending at least partially from said front to rear portions on at least one of said top and bottom walls and forming guide channels having a width dimension sufficient for receipt of at least one of the top and bottom margins of said articles, said vanes extending outwardly of at least one of said top and bottom walls a distance less than the distance between said top and bottom walls; and (d) a plurality of elastic connectors extending between said bottom and top walls in generally parallel relation and defining resiliently flexible and expansible partitions forming side-by-side compartments sized for respectively receiving the articles therein.

2. The storage rack set forth in claim 1 including:

(a) a plurality of elongate, parallel, trays respectively movably mounted in said guide channels on said bottom wall, said trays being slidable from said guide channels for carrying respective said articles from said storage rack and presenting said articles for removal.

3. The storage rack set forth in claim 2 wherein:

(a) said trays respectively have a width dimension commensurate with a thickness of said article and a height dimension substantially less than said distance between said top and bottom walls.

4. The storage rack set forth in claim 3 wherein:

(a) said trays respectively have a front portion having a face for applying indicia thereto identifying a respective said article on said tray and a tab adjacent said face providing a fingerhold for sliding said tray.

5. The storage rack set forth in claim 4 wherein:

(a) said vanes extend from said top and bottom walls in top to bottom alignment for receiving corresponding top and bottom margins of said articles and positioning said articles in perpendicular relation to said top and bottom walls.

6. A storage rack for articles such as phonograph albums and the like comprising:

(a) a bottom wall having front and rear portions and adapted for engagement with a top surface of a bottom supportive structure;

(b) a top wall having front and rear portions and adapted for engagement with a bottom surface of a top supportive structure whereby said top wall is spaced vertically from said bottom wall a distance not less than a height dimension of an article for insertion therebetween;

(c) a plurality of elongate vanes extending from said bottom wall and said top wall and forming parallel guide channels open from said front to rear portions;

(d) a plurality of narrow trays for carrying a respective said article, said trays being respectively movably mounted in said guide channels and slidable outwardly of said front portions for presenting said article for removal; and (e) a plurality of elastic connectors extending between upper and lower sets of said guide channels in parallel relation at said front portions and dividing the storage rack into a plurality of side-by-side receptacles having expansible partitions between said guide channels whereby cleaning tools and the like can be inserted into said storage rack.

7. A storage rack for articles such as phonograph albums and the like comprising:

(a) top and bottom walls;

(b) means supporting said top wall in overlying relation to said bottom wall and spaced therefrom a distance not less than a height dimension of articles for insertion into the storage rack; and (c) a plurality of elastic connectors extending between said bottom and top walls in generally parallel relation and defining resiliently flexible and expansible partitions forming side-by-side compartments sized for respectively receiving the articles therein;

(d) said top and bottom walls respectively having front margins and top and bottom channels respectively extending along said front margins; and (e) said elastic connectors having top and bottom end portions respectively engaged in said top and bottom channels of said top and bottom walls.

8. A storage rack for articles such as phonograph records and the like comprising:

(a) top and bottom walls having front and rear portions;

(b) means supporting said top wall in overlying relation to said bottom wall and spaced therefrom a distance not less than a height dimension of articles for insertion into the storage rack;

(c) a plurality of elongate, parallel, vanes extending at least partially from said front to rear portions on said bottom wall and forming parallel guide channels;

(d) a plurality of narrow trays for carrying respective said articles, said trays being respectively movably mounted in said guide channels and slidable outwardly of said front portions for presenting said articles for removal; and (e) a plurality of elastic connectors extending between said top and bottom walls in generally parallel relation and defining resiliently flexible and expansible partitions forming side-by-side compartments sized for respectively receiving the articles therein.

* * * * *